US007522870B2

(12) United States Patent
Fujino

(10) Patent No.: US 7,522,870 B2
(45) Date of Patent: Apr. 21, 2009

(54) IMAGE HEATING APPARATUS WITH CONTROL MEANS FOR CONTROLLING HEATING ROTATABLE MEMBER IN ACCORDANCE WITH BELT OPERATION

(75) Inventor: Takeshi Fujino, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 352 days.

(21) Appl. No.: 11/447,162

(22) Filed: Jun. 6, 2006

(65) Prior Publication Data

US 2007/0059059 A1 Mar. 15, 2007

(30) Foreign Application Priority Data

Sep. 13, 2005 (JP) ..... 2005-266010

(51) Int. Cl.
*G03G 15/20* (2006.01)

(52) U.S. Cl. ..... 399/329; 399/122; 399/70

(58) Field of Classification Search ..... 399/68, 399/70, 122, 329, 330
See application file for complete search history.

(56) References Cited

U.S. PATENT DOCUMENTS 5,049,945 A * 9/1991 Fukano et al. ..... 399/122
5,305,066 A * 4/1994 Koh et al.
2005/0220466 A1* 10/2005 Takahashi et al. ..... 399/329
2005/0220467 A1* 10/2005 Takahashi et al. ..... 399/329
2005/0276624 A1 12/2005 Fujino ..... 399/69
2006/0083562 A1* 4/2006 Matsumoto et al. ..... 399/329
2006/0133869 A1* 6/2006 Sata ..... 399/329
2006/0245800 A1 11/2006 Fujino ..... 399/329

FOREIGN PATENT DOCUMENTS

JP 11194647 A * 7/1999
JP 11-231701 8/1999

* cited by examiner

*Primary Examiner*—David M Gray
*Assistant Examiner*—Laura K Roth
(74) *Attorney, Agent, or Firm*—Fitzpatrick, Cella, Harper & Scinto

(57) ABSTRACT

An image heating apparatus includes a heating rotatable member and a belt cooperative with the heating rotatable member to form the nip in which an image on a recording material is heated. The apparatus further includes swinging means for swing the belt in a widthwise direction and control means for controlling a rotational speed of the heating rotatable member. The control means rotates the heating rotatable member at a relatively low speed when the belt is brought into contact to the heating rotatable member while the swinging means is swing the belt, and the control means effects an increase of the rotational speed of the heating rotatable member before the heating operation is started.

5 Claims, 11 Drawing Sheets

IMAGE HEATING APPARATUS WITH CONTROL MEANS FOR CONTROLLING HEATING ROTATABLE MEMBER IN ACCORDANCE WITH BELT OPERATION

FIELD OF THE INVENTION AND RELATED ART

The present invention relates to an image heating apparatus for heating an image on recording medium. As examples of an image heating apparatus, a fixing apparatus for fixing an image on recording medium, an apparatus for improving an image in glossiness by heating a fixed image on recording medium, etc., can be listed. An image heating apparatus is employed by an image forming apparatus such as a copying machine, a printing machine, a facsimile machine, etc.

An electrophotographic image forming apparatus, such as a copying machine, a printer, a facsimile machine, etc., which uses toner is provided with a fixing apparatus for fixing a toner image on recording medium by thermally melting the toner image after the toner image is transferred onto the recording medium.

Japanese Laid-open Patent Application 11-231701 discloses a fixing apparatus which employs a fixation belt. A fixing apparatus, such as the one disclosed in the abovementioned patent application, which employs a fixation belt, is provided with a mechanism for controlling the snaking of the fixation belt.

The mechanism for controlling the snaking of the fixation belt is structured so that one of the rollers by which a fixation belt is suspended can be changed in angle to control the direction in which the belt deviates, and the velocity at which the belt deviates.

While a fixing apparatus employing a fixation belt is not used for fixation, its fixation belt is kept separated from its fixation roller.

Shown in FIG. 11 is the operational sequence of a fixing apparatus, such as the one disclosed in Japanese Laid-open Patent Application 11-231701, which employs a fixation belt.

According to this sequence, while the fixing apparatus is kept on standby, its fixation roller is kept stationary, whereas its fixation belt is rotated while being kept separated from the fixation roller. As a copy start signal is inputted while the fixing apparatus is kept on standby, the fixation roller begins to rotate at a preset fixation speed. As the fixation roller reaches its preset fixation speed and begins to rotate at its preset fixation speed, the fixation belt is placed in contact with the fixation roller, and then, begins to be pressed against the fixation roller. After a certain length of time, the operation for pressing the fixation belt against the fixation roller ends. Then, recording paper is moved into the fixation nip N.

However, operating the fixation roller and fixation belt following the operation sequence such as the one described above in accordance with the prior art often resulted in the following problem.

That is, in the case of a fixing apparatus structured in accordance with the prior art, when its fixation belt is placed in contact with its fixation roller at the beginning of an image forming operation, the fixation roller is rotating at the high velocity, at which the fixation roller is rotated for fixation. Therefore, the control of the snaking of the belt becomes unstable, sometimes allowing the belt to deviates beyond the normal snaking range. This phenomenon has become more conspicuous as the fixation speed of the fixation roller of a fixing apparatus has come to be increased because the image formation speed of an image forming apparatus has come to be increased.

The occurrence of this phenomenon results in an error in the control of the snaking of the fixation belt. Therefore, if this phenomenon occurs, the on-going image forming operation has to be interrupted. Thus, until the operation of the fixing apparatus is restored, the image forming apparatus is not usable for image formation. This is extremely inconvenient for an operator who wants to quickly form images.

SUMMARY OF THE INVENTION

The primary object of the present invention is to provide an image heating apparatus, the fixation belt of which can be satisfactorily oscillated in its width direction.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, one of the preferred embodiments of the present invention will be described with reference to the appended drawings. First, the general structure of the image forming apparatus in accordance with the present invention will be described. Then, the fixing apparatus, as an image heating apparatus in accordance with the present invention, in this embodiment of the present invention will be described.

(Image Forming Apparatus)

First, referring to FIG. 10, the image forming apparatus will be described.

Figure 10:
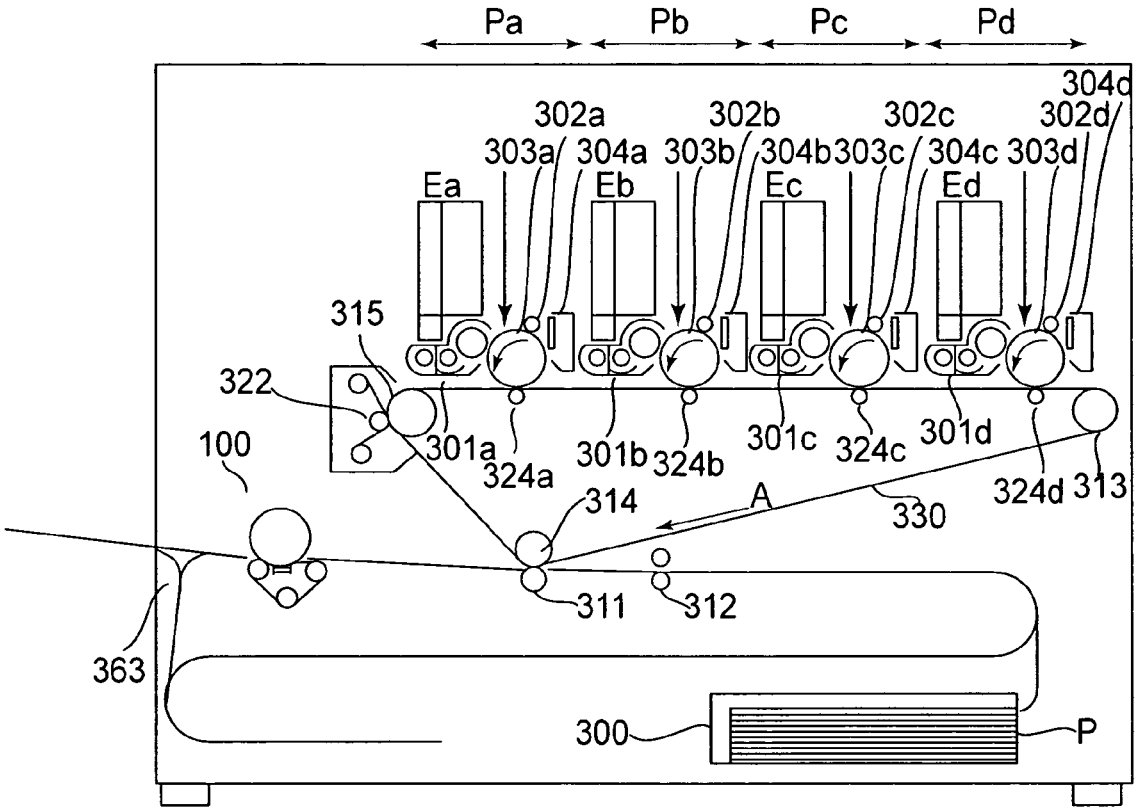
FIG. 10 is a cross-sectional view of the image forming apparatus in accordance with the present invention, showing the general structure thereof.
Figure 11:
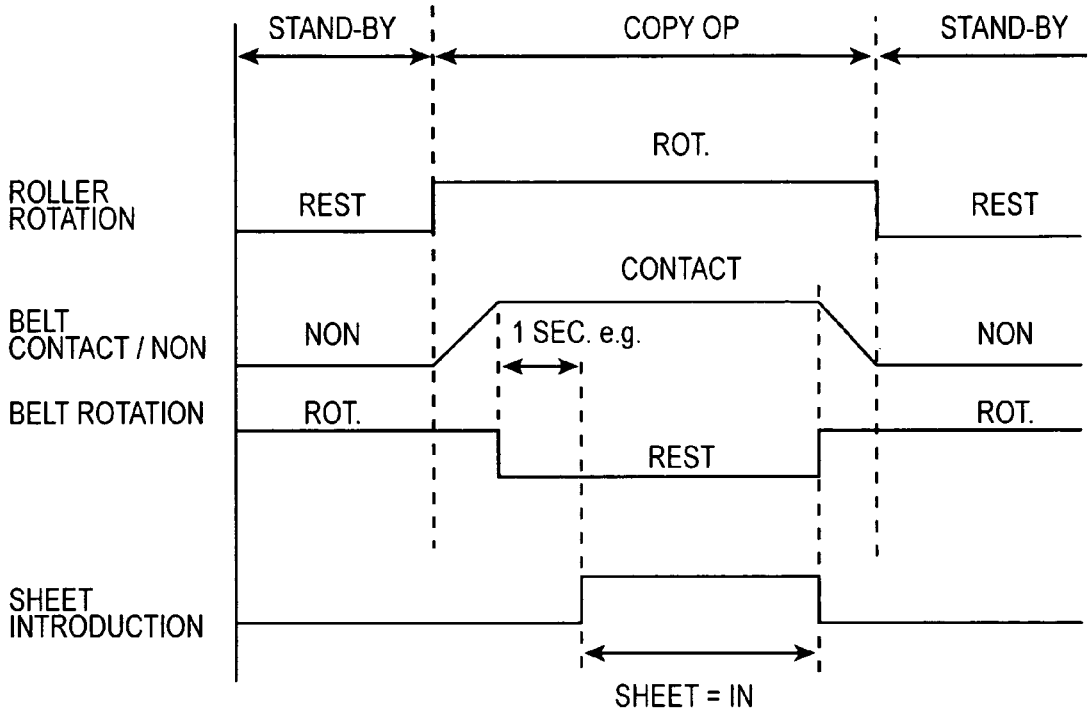
FIG. 11 is a diagrammatic drawing depicting the operational timing of a fixing apparatus in accordance with the prior art, more specifically, the timing with which the fixation roller and fixation belt are driven, the timing with which the fixation belt is placed in contact with the fixation roller, and the timing with which the fixation belt is separated from the fixation roller.

Within the apparatus shown in FIG. 10, first to fourth image forming portions Pa, Pb, Pc, Pd (image forming means) are disposed in parallel to form four monochromatic toner images different in color through the process of forming a latent image, process of developing the latent image, and process of the developed latent image.

The image forming portions Pa, Pb, Pc, and Pd are provided with their own image bearing members, which in this embodiment are electrophotographic photosensitive drums 303*a*, 303*b*, 303*c*, and 303*d*, respectively, on which monochromatic toner images different in color are formed, one for one. The image forming apparatus is provided with an intermediary transferring member 330, which is disposed next to the photosensitive drums 303*a*, 303*b*, 303*c*, and 303*d*. The toner images formed on the photosensitive drums 303*a*, 303*b*, 303*c*, and 303*d*, one for one, are transferred (primary transfer) onto the intermediary transferring member 330, and then, are transferred onto a sheet of recording medium P in the secondary transferring portion. After the transfer of the toner images onto the recording medium P, the recording medium P is subjected to heat and pressure in a fixing apparatus 100 to fix the toner images. Then, the recording medium P is discharged as a permanent copy from the image forming apparatus.

Adjacent to the peripheral surfaces of the photosensitive drums 303*a*-303*d*, drum charging devices 302*a*-303*d*, developing devices 301*a*-303*d*, primary transfer charging devices 324*a*-324*d*, and cleaners 304*a*-304*d* are disposed, respectively. The image forming apparatus is also provided with an unshown light source apparatus and an unshown polygon mirror, which are in the top portion of the image forming apparatus main assembly.

A beam of laser light is emitted from the light source apparatus toward the polygon mirror, which is being rotated. As a result, the beam of laser light is deflected in an oscillatory fashion. Then, this oscillatory beam of laser light is deflected by a reflection mirror, and then, is focused on the peripheral surfaces of the photosensitive drums 303*a*, 303*b*, 303*c*, and 303*d* by an f-θ lens. In other words, the numerous points of the peripheral surface of each of the photosensitive drums 303*a*, 303*b*, 303*c*, and 303*d* are selectively exposed in response to image formation signals (video signals). As a result, a latent image in accordance with the image formation signals is formed on each of the photosensitive drums 303*a*, 303*b*, 303*c*, and 303*d*.

The developing apparatuses 301*a*, 301*b*, 301*c*, and 301*d* contain preset amounts of yellow, magenta, cyan, and black toners, respectively, as developers, which are supplied by unshown toner supplying apparatuses. The developing devices 301*a*, 301*b*, 301*c*, and 301*d* develop the latent images on the photosensitive drums 303*a*, 303*b*, 303*c*, and 303*d*, into visible images formed of yellow, magenta, cyan, and black toners, respectively.

The intermediary transferring member 330 is rotated at the same velocity as the peripheral velocities of the photosensitive drums 303, in the direction indicated by an arrow mark.

The visible image on the photosensitive drum 303*a*, that is, the image formed of the toner of yellow color (first color), is moved through the nip between the photosensitive drum 303*a* and intermediary transferring member 330. While the image formed of the yellow toner is moved through the nip, it is transferred (intermediary transfer) onto the outward surface (in terms of loop which intermediary transferring member forms) of the intermediary transferring member 330, by the electric field formed by the transfer bias applied to the intermediary transferring member 330, and the pressure in the nip.

Similarly, the visible image formed of the toner of magenta color, or the second color, the visible image formed of the toner of cyan color, or the third color, and the visible image formed of the toner of black color, or the fourth color, are sequentially transferred in layers onto the yellow toner image on the intermediary transferring member 330. As a result, a color copy of an original is synthetically effected on the intermediary transferring member 330.

Designated by a referential symbol 311 is a secondary transfer roller, which is supported by bearings, and is parallel to the rollers suspending the intermediary transferring member 330 and in contact with the downwardly facing portion of the outward surface of the intermediary transferring member 330. To the secondary transfer roller 311, a preset secondary transfer bias is applied by a secondary transfer bias source. The color image which has just been effected on the intermediary transferring member 330 by transferring, in layers, multiple monochromatic toner images, different in color, onto the intermediary transferring member 330 is transferred onto the recording medium P in the following manner. That is, the recording medium P is fed from a sheet feeder cassette 300, is conveyed by a pair of registration rollers 312, is moved past a transferring portion entrance guide, and is delivered to the contact nip between the intermediary transferring member 330 and secondary transfer roller 311 with a preset timing. At the same time as the delivery of the recording medium P to the contact nip, the application of the secondary transfer bias from a bias application power source is started. As a result, the synthetically formed color image on the intermediary transferring member 330 is transferred by this secondary transfer bias onto the recording medium P.

After the completion of the primary transfer, the photosensitive drums 303*a*, 303*b*, 303*c*, and 303*d* are cleaned by the cleaners 304*a*, 304*b*, 304*c*, and 304*d*, respectively (toner remaining on the photosensitive drums 303 are removed by the cleaners 304), being thereby prepared for the subsequent process of forming a latent image. The toner and other debris remaining on the intermediary transferring member 330 are wiped away by placing a piece of cleaning web (nonwoven fabric) in contact with the surface of the intermediary transferring member 330.

After the transfer of the color image (multiple monochromatic toner images different in color), the transfer medium P is introduced into the fixing apparatus 100. In the fixing apparatus 100, the color image is fixed to the transfer medium P by the application of heat and pressure to the transfer medium P. Then, the transfer medium P is discharged from the image forming apparatus through a sheet outlet 363.

(Fixing Apparatus)

Next, referring to FIG. 2, the fixing apparatus 100 as an example of the image heating apparatuses in accordance with the present invention will be described.

Figure 2:
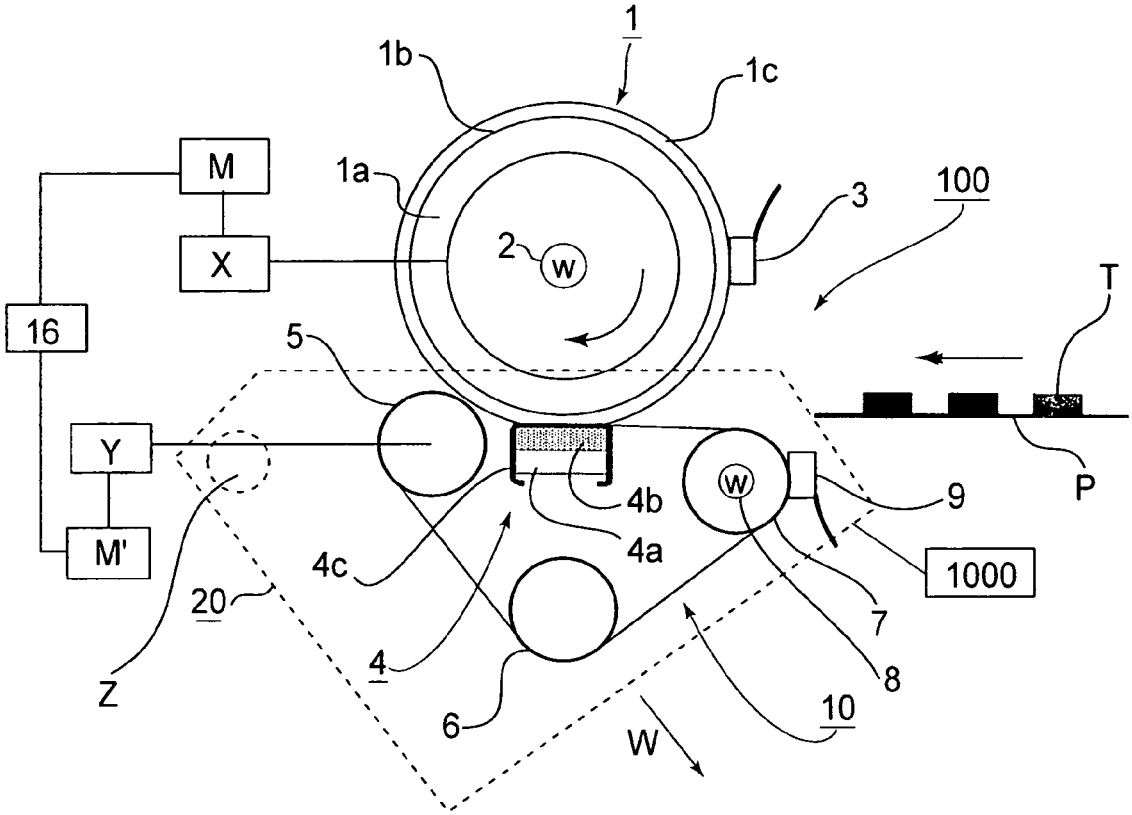
FIG. 2 is a sectional view of the fixing apparatus in accordance with the present invention, minus the means for controlling the snaking of the fixation belt.

FIG. 2 is a sectional view of the fixing apparatus 100, showing the general structure thereof. FIG. 2 primarily shows the fixation roller 1, as a heating roller, which contains a heat source, and a belt unit 20.

The belt unit 20 is made up of an endless belt 10 and a pressure applying member 4, a separation roller 5, a steering roller 6, and an inlet roller 7. The pressure applying member 4 presses the endless belt 10 against the fixation roller 1, from the inward side (in terms of fixation belt loop), thereby forming a fixation nip between the fixation belt 10 and fixation roller 1. The three rollers, that is, the separation roller 5, steering roller 6, and inlet roller 7, are the belt supporting rollers, around which the belt 10 is stretched. The fixing apparatus in this embodiment is also provided with a mechanism for controlling the snaking of the belt 10. This mechanism is a belt oscillating means for oscillating the belt 10 in the width direction of the belt 10. This mechanism for controlling the snaking of the belt 10 will be described later with reference to FIG. 3.

The fixation roller 1 is made up of a cylindrical metallic core 1*a*, an elastic layer 1*b*, a release layer 1*c*, which are concentric. The metallic core 1*a* is formed of a metal such as aluminum that is high in thermal conductivity. The elastic layer 1*b* is formed on the peripheral surface of the metallic core 11*a*, of an elastic substance such as silicone rubber. The release layer 1*c* is formed on the peripheral surface of the elastic layer 1*b*, of such a material as a piece of PFA tube that is excellent in terms of heat resistance and toner release. Within the hollow of the metallic core 1*a*, a halogen lamp 2 is disposed as a heat source. The fixing apparatus 100 is also provided with a temperature sensor 3, which is disposed in contact with the peripheral surface of the fixation roller 1 to detect the surface temperature of the fixation roller 1. Based on the output signals from the temperature sensor 3, a controller 16 turns on and off (feedback control) the halogen lamp 2 to keep the surface temperature of the fixation roller 1 at a preset level (fixation temperature).

The fixing apparatus 100 is structured so that the fixation roller 1 is rotated in the direction indicated in FIG. 2 by the driving force transmitted to the fixation roller 1 from a motor M through a driving force transmission gear train X (FIG. 2).

The fixing apparatus 100 is structured so that the fixation roller 1 can be driven at two or more peripheral velocities (two in this embodiment: 50 mm/s and 200 mm/s) during a fixing operation (heating operation). In other words, it is structured so that the peripheral velocity at which the fixation roller 1 is rotated can be selected based on the type of recording medium. More specifically, it is structured so that the output of the motor M can be switched by the controller 16 (FIGS. 2 and 3) based on the type of recording medium. It is also structured so that the information regarding the type of recording medium is to be manually inputted by an operator. It is based on this information that the controller 16 switches the peripheral velocity of the fixation roller 1. From the standpoint of operability, a fixing apparatus is desired to be structured so that the type of recording medium is automatically detected by a recording medium type detection sensor of the main assembly of an image forming apparatus, and also, so that the controller 16 selects the peripheral velocity for a fixation roller based on the result of the detection of the recording medium type by the sensor.

In this embodiment, the peripheral velocity of the fixation roller 1 is controlled by the controller 16 so that when recording medium is thin (when it is thin paper or ordinary paper), the fixation roller 1 is rotated at the high velocity (200 mm/s). Further, the fixing apparatus 100 is structured so that the fixation belt 10 is rotated by the rotation of the fixation roller 1. Therefore, the fixation belt 10 is rotated at roughly the same velocity as the peripheral velocity of the fixation roller 1.

Further, the peripheral velocity of the fixation roller 1 is controlled by the controller 16 so that when recording medium is thick (it is cardstock or coated paper), the fixation roller 1 rotates at a peripheral velocity (50 mm/s) which is lower than the abovementioned one. Therefore, the fixation belt 10 is rotated moved at roughly the same velocity as the peripheral velocity of the fixation roller 1, because the fixing apparatus 100 is structured so that the fixation belt 10 is rotated by the rotation of the fixation roller 1.

The belt unit 20 is structured so that the aforementioned belt 10 formed of heat resistant resin film such as polyimide film is stretched around the aforementioned three rollers as supporting rollers, that is, the separation roller 5, steering roller 6, and in roller 7, being thereby supported by the three rollers.

The separation roller 5 is a rotatable pressure application roller, which is pressed by an unshown pressure application mechanism so that it presses on the fixation roller 1, with the presence of the belt 10 between it and the fixation roller 1. Thus, the elastic layer 1*b* of the fixation roller 1 is deformed by this separation roller 5 so that the toner image having entered the fixation nip is separated from the fixation roller 1 by the deformation of the elastic layer 1*b*.

The fixing apparatus 100 in this embodiment is also provided with a belt unit moving mechanism 1000 (FIG. 2), which rotates the belt unit 20 about the rotational axis Z in the direction indicated by an arrow mark W from the position in which the belt unit 20 performs a fixing operation to the position in which it remains separated from the fixation roller 1, when a fixing operation ends. On the other hand, as an image formation start signal is inputted, this belt unit moving mechanism 1000 moves the belt unit 10 about the rotational axis Z in the direction opposite to the direction indicated by the arrow mark W so that the belt 10 is placed in contact with the fixation roller 1.

Incidentally, the fixing apparatus 100 in this embodiment is structured so that even when the belt 10 is kept in the position in which it is not in contact with the fixation roller 1, that is, even when the fixing apparatus 100 is kept on standby, the belt 10 is rotated at the low velocity (50 mm/s). This arrangement is made to keep the temperature of the entirety of the belt 10 at the standby level, by keeping the halogen heater disposed in the inlet roller 7, turned on even while the fixing apparatus 10 is kept on standby, as will be described later. The employment of this structural arrangement makes it possible to quickly ready the fixing apparatus 100 on standby, for a fixing operation (heating operation), as soon as an image formation start signal is inputted. More specifically, the fixing apparatus 100 is structured so that while the fixation belt 10 is kept separated from the fixation belt 1, that is, when the fixing apparatus 100 is kept on standby, the belt 10 is rotated by the driving force inputted to the separation roller 5 from the motor M through a driving force transmission mechanism Y (FIG. 2). Incidentally, the fixing apparatus 100 is structured so that during a fixing operation (heating operation), the belt 10 is rotated by the rotation of the fixation roller 1 as described above. In other words, in this embodiment, during a fixing operation, the controller 16 turns off the motor M, and therefore, no driving force is inputted to the separation roller 5. However, as long as the belt 10 is not prevented from being rotated by the rotation of the fixation roller 1 during a fixing operation, the separation roller 5 may be driven by the motor M even during a fixing operation.

The steering roller 6 as a belt oscillating means is adjusted in angle in response to the belt position in terms of its width direction, in order to oscillate the belt 10 in its width direction. More specifically, the controller 16 as the belt oscillating means adjusts the angle of the steering roller 6 in response to the position of the belt 10 in terms of the width direction of the belt 10 to ensure that the belt 10 remains within the oscillatory range in which the belt 10 can perform a fixing operation (heating operation). The details of this control will be given later.

The inlet roller 7 is disposed at the inlet of the fixing apparatus 100, through which paper (recording medium P) is conveyed into the fixing apparatus 100. It is disposed in parallel to the pressure applying member 4 so that paper (recording medium P) remains flat while it is introduced into the fixation nip formed by the fixation roller 1 and pressure applying member 4. Further, a halogen heater is disposed in the hollow of the inlet roller 7, as described above, to heat the belt while the belt is in the retreat position, in which it is kept separated from the fixation roller 1. Further, in this embodiment, when the belt 10 is in contact with the fixation roller 1, that is, when the belt 10 is in the position in which it is ready for a fixing operation (heating operation), the power is not supplied to this halogen heater.

The pressure applying member 4 is made up of a support plate 4*a*, an elastic layer 4*b* formed on the support plate 4*a*, of silicone rubber or the like, and a low friction layer 4*c* formed on the elastic layer 4*b* by coating the elastic layer 4*b* with fluorinated resin or the like. The pressure applying member 4 is pressed against the fixation roller 1 by an unshown pressure application mechanism, with the belt 10 placed between the pressure applying member 4 and fixation roller 1.

(Snaking Controlling Means)

Figure 3:
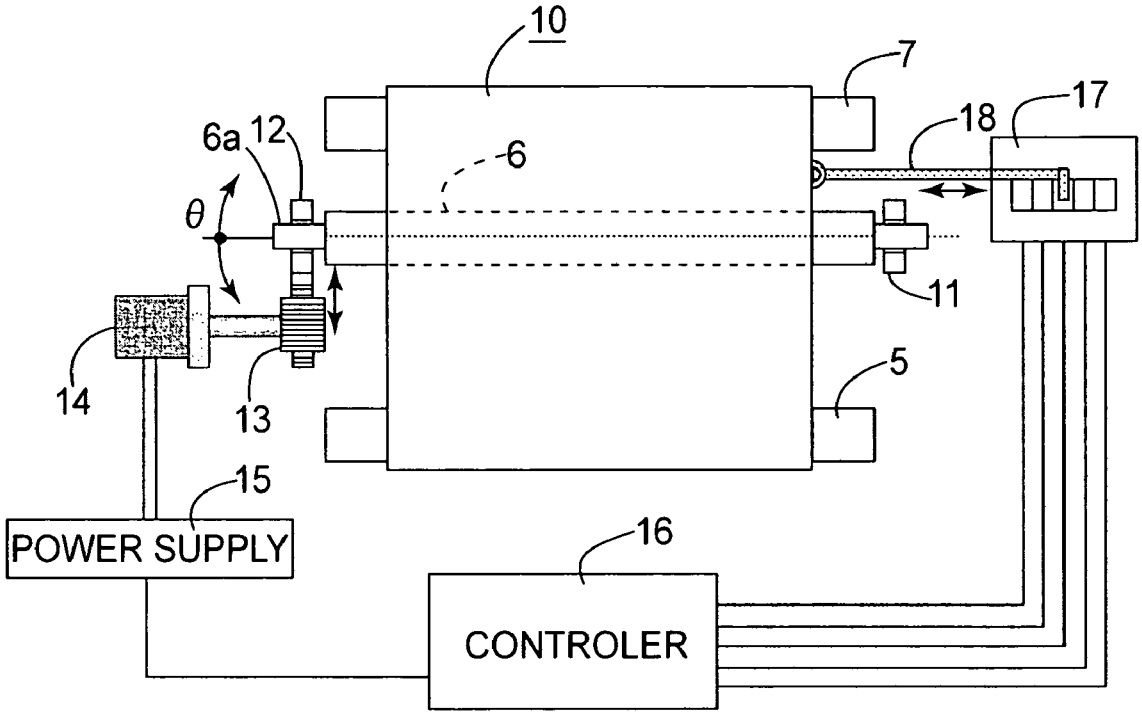
FIG. 3 is a schematic view of the fixing apparatus in accordance with the present invention, describing the means for controlling the snaking of the fixation belt.

Next, the snaking controlling means as a belt oscillating means will be described regarding its structure. FIG. 3 is a drawing of the belt unit and belt snaking controlling means of the fixing apparatus employing a fixation belt, showing primarily the belt snaking controlling means; the heat source and pressure applying member are not shown.

Designated by a referential symbol 10 is a belt, and designated by referential symbols 5 and 7 are two of the three rollers which stretch and support the belt 10 from the inward side of the belt loop. Designated by a referential symbol 6 is the steering roller which not only provides the belt 10 with tension by stretching and supporting the belt 10 from the inward side of the belt loop as do the rollers 5 and 7, but also, controls the snaking of the belt 10. The steering roller 6 is made up of the shaft 6*a*, and an elastic layer molded around the shaft 6*a* so that it becomes integral with the shaft 6*a*.

The steering roller 6 is adjustable in inclination (angle) by the steering roller holders 11 and 12 which are opposite in the phase of their movement. More specifically, the direction in which the belt 10 is allowed to deviate in terms of the width direction of the belt, and the velocity at which the belt 10 is allowed to deviate, are controlled by adjusting the angle θ of the steering roller 6 relative to the belt 10 by the controller 16.

The steering roller holder 12 is provided with a rack portion, which constitutes one of the end portions of the holder 12. The rack portion of the steering holder 12 is engaged with a gear 13 attached to the output shaft of a snaking controlling motor 14. Therefore, the steering roller holder 12 can be moved by the rotation of the snaking controlling motor 14. The electric power to the snaking controlling motor 14 is supplied by a power source 15, which is electrically connected to the controller 16. Consequently, the snaking controlling motor 14 is controlled by the controller 16. The controller 16 also has electrical connection to a belt position sensor 17 as a belt position detecting means, which is a part of a belt position detecting means which will be described next.

The belt position detecting means is provided with an arm 18, one of the lengthwise ends of which is kept in contact with one of the lateral edges of the belt 10 by a spring, and the other lengthwise end which is provided with a flag. The belt position sensor 17 is provided with five photosensors, which are aligned in the direction parallel to the lengthwise direction of the arm 18. Further, the arm 18 and belt position sensor 17 are positioned so that the flag of the arm 18 blocks one of the five photosensors of the belt position sensor 17. Thus, the position of the belt 10 (position of one of lateral edges of belt 10) in terms of its width direction can be determined by detecting which of the five photosensors of the belt position sensor 17 is blocked by the flag on the arm 18. Thus, the controller 16 controls the snaking of the belt 10 in response to the signals from the belt position sensor 17, which shows the position of the belt 10 (position of one of lateral edges of belt 10) in terms of the width direction of the belt 10; the controller 16 decides whether the steering roller 6 is to be adjusted in inclination (results of adjustment are fed back to controller 16).

The five photosensors of the belt position sensor 17 are positioned so that they can detect the following statuses of the belt 10: "belt having shifted too close to the front side, being therefore to be immediately stopped", "belt having deviated toward the front side far enough to start the control to move the belt rearward", and "belt being roughly in the center". In addition to these belt statuses, "belt having deviated toward the rear side far enough to start the control to move the belt frontward", and "belt having deviated too close to the rear side, being therefore required to be immediately stopped". In terms of the size of the arm 18 and the intervals of the photosensors of the belt position sensor 17, the belt position detecting means is structured so that the flag always blocks one of the photosensors to prevent the belt position sensor 17 from failing to output the information regarding the belt position. Incidentally, the terms "frontward" and "rearward", used to describe the position of the belt 10, in the description of this embodiment correspond to the "front side" and "rear side" of the image forming apparatus as shown in FIGS. 1 and 4-8. That is, that the belt 10 moves toward the "front side" of the image forming apparatus means that the belt 10 moves "frontward".

At this time, referring to FIGS. 4-7, the operation for controlling the snaking of the belt 10 will be described.

The multiple arrow marks, in FIGS. 4-7, drawn with solid lines in the pattern of a triangular waveform show the belt position, the amount of the belt movement in the width direction of the belt, and the amount of the belt movement in terms of the rotational direction of the belt 10, which were detected by the belt position detecting means, the arm of which was in contact with one of the lateral edges of the belt 10.

The positions of "deviation limit" and "angle switch" correspond to the photosensors of the belt position sensor 17. In other words, the above phrases mean that the belt 10 has deviated to the positions described by these phrases. The position of "angle switch" means the position at which the steering roller 6 is to be switched in the angle relative to the direction perpendicular to the lateral edges of the belt 10; the steering roller 6 is switched in its angle relative to the direction perpendicular to the lateral edges of the belt 10, from the positive angle to the negative angle, or from the negative angle to the positive angle. That the belt 10 is at the "deviation limit" means that the belt 10 is in the position in which a measure such as immediately stopping the rotation of the fixation roller of the fixing apparatus to prevent the belt 10 from being severed must be taken. As for the method for controlling the snaking of the belt 10, when the belt 10 is wanted to move frontward, the steering roller 6 is to be positively tilted by an angle of θ, whereas when the belt 10 is wanted to move rearward, the steering roller 6 is to be negatively tilted by the angle of θ.

Figure 4:
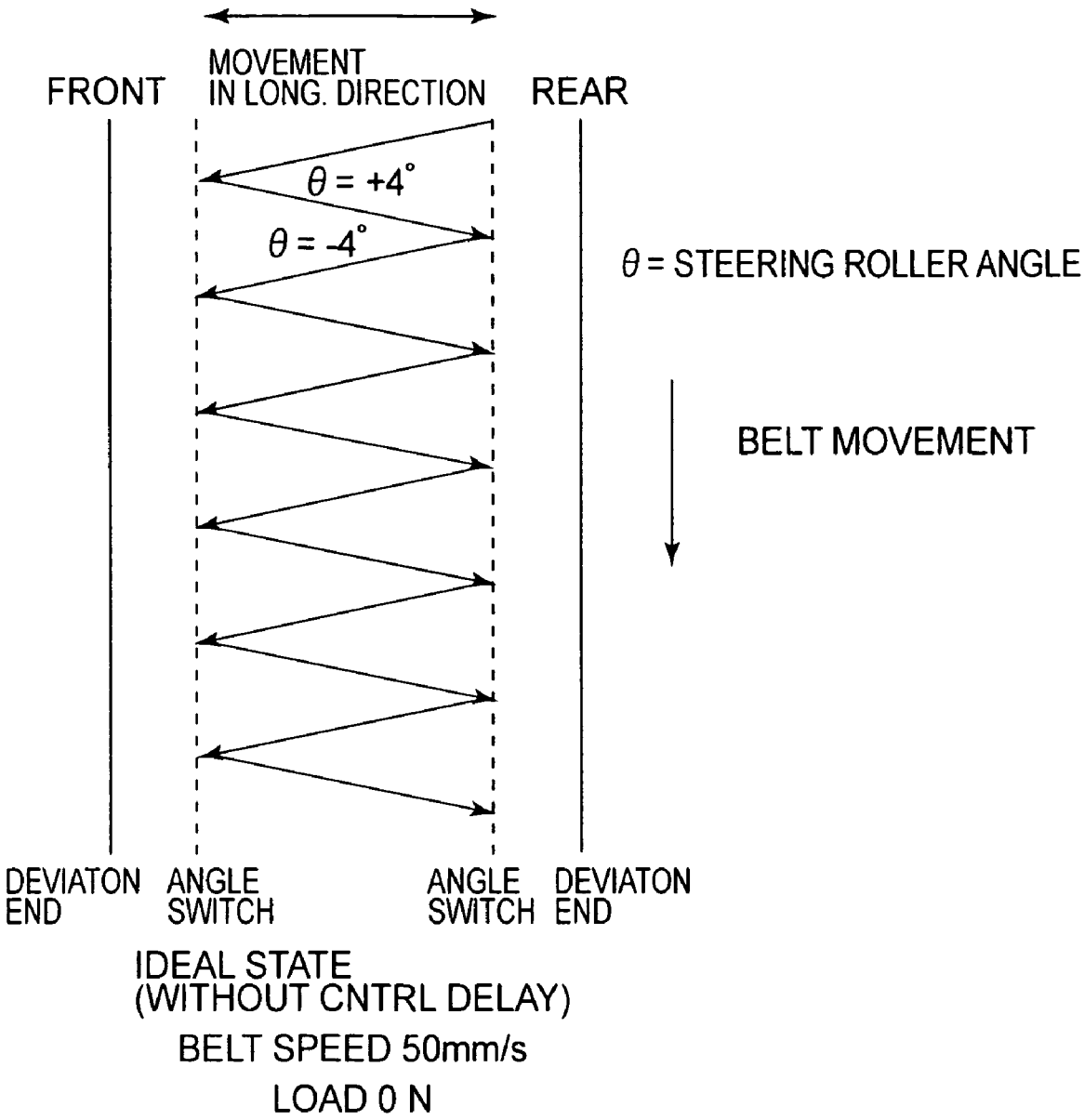
FIG. 4 is a diagrammatic drawing depicting the theoretical controlled snaking of the fixation belt, that is, the controlled snaking of the fixation belt, which occurs when there is no control delay.

FIG. 4 is a drawing showing the ideal belt snaking controlling operation, that is, the belt snaking controlling operation which is assumed to have no delay in control. In this operation, the belt velocity is 50 mm/s, and the amount of belt load is 0 [N] assuming that the fixing apparatus is on standby. The two values between which the steering roller 6 is switched in angle are +4° and −4°. As shown in FIG. 4, when the fixing apparatus 100 is in the very ideal condition, the belt 10 is reversed in the snaking direction the moment the belt position sensor 17 detects that the lateral edge of the belt 10 is at the point of "angle switch". Therefore, as long as the amount of the positional deviation of the belt 10 attributable to the alignment errors or the like, of the belt unit itself does not exceed the amount by which the belt 10 can be controlled in lateral movement by controlling the angle of the steering roller 6, it will never occur that the lateral edge of the belt 10 reaches the point of "deviation limit". However, in reality, there is the so-called control delay in a belt snaking controlling operation. This control delay is attributable to, for example, the gear backlash. More specifically, all gears are provided with a certain amount of backlash to prevent the problems such as lockup and/or cracking of gears. Therefore, if a gear which is driving another gear is reversed in rotational direction, it takes a small amount of time for the driving gear to properly mesh with the gear which has been driven. In other words, a small amount of delay occurs. There occur other control delays in addition to the delay attributable to the gear backlash. For example, a small amount time is necessary to change the steering roller 6 in angle, and it takes a certain length of time for the controller 16 to carry out internal computation and begin to control the belt snaking after the belt position sensor 17 detects the belt position, although the length of the time the controller 16 requires for these purposes is extremely short.

Figure 5:
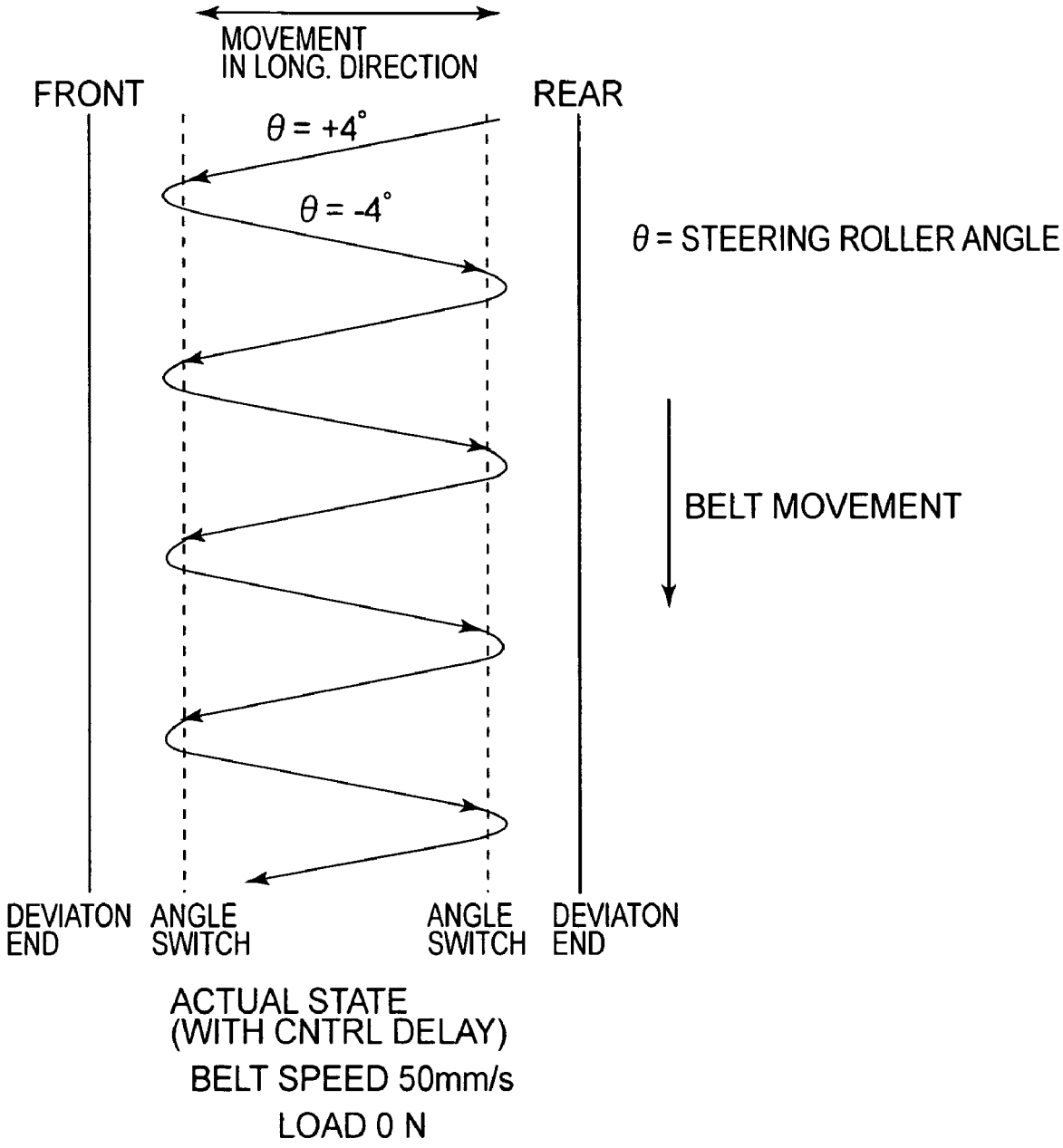
FIG. 5 is a diagrammatic drawing depicting the actual controlled snaking of the fixation belt, that is, the controlled snaking of the fixation belt, which occurs when the belt is kept separated from the fixation roller, and there are control delays.

Shown in FIG. 5 is the actual belt snaking controlling operation, that is, the belt snaking controlling operation which has the above described control delays. Also in this operation, the belt velocity is 50 mm/s, and the amount of belt load was assumed to be 0 [N], as they were in the operation shown in FIG. 4. In the case of the belt snaking controlling operation shown in FIG. 5, however, there are the control delays. In other words, FIG. 5 shows that after it is detected that the belt 10 is at the point of "angle switch", the belt 10 continues to move toward the point of "deviation limit" by a distance equal to 24% of the control margin, which is the distance between the point of "angle switch" and the point of "deviation limit". This movement of the belt 10 beyond the point of "angle switch", which equals to 24% of the control margin, is acceptable from the standpoint of the satisfactory control of the snaking of the belt.

Figure 6:
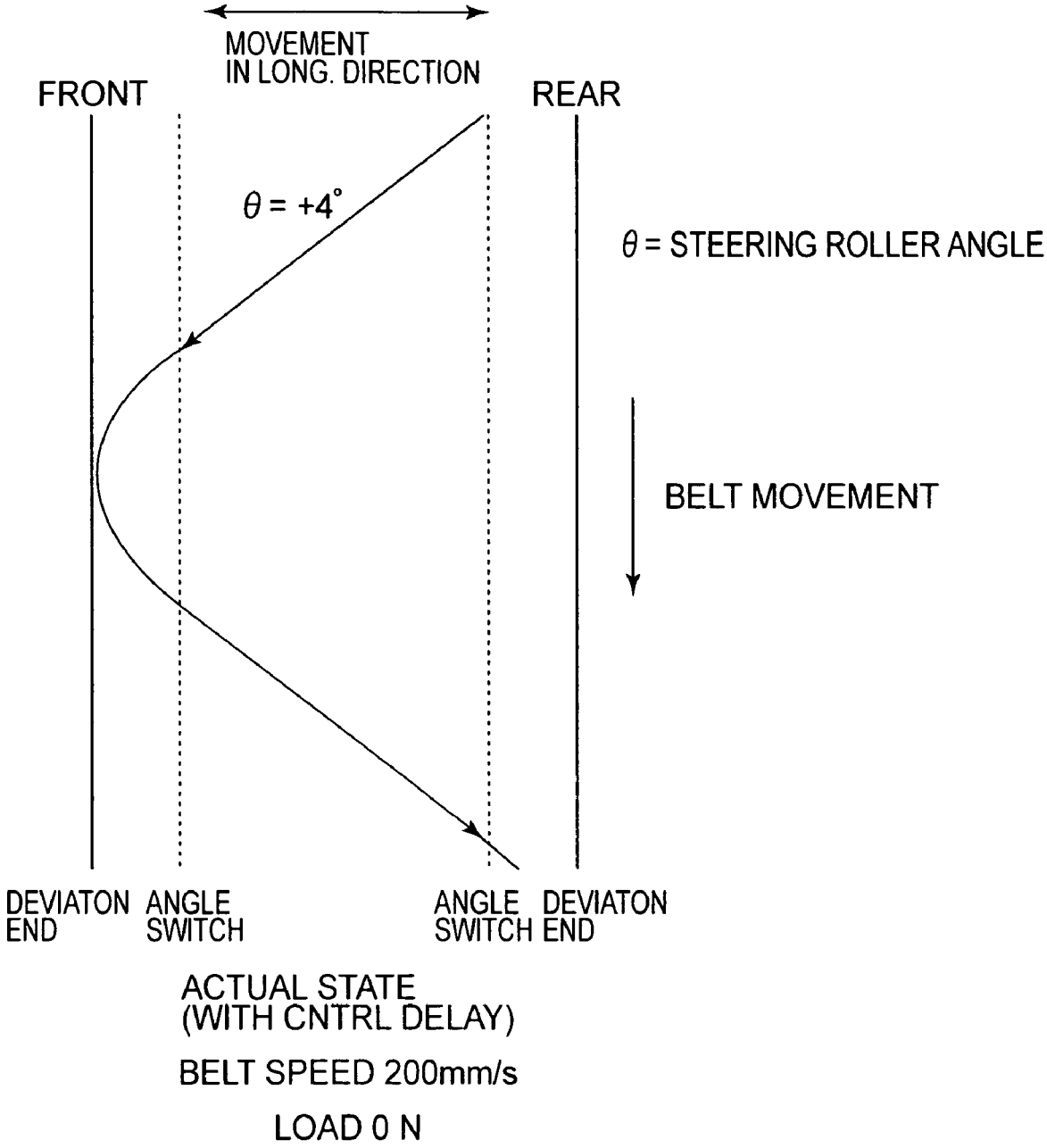
FIG. 6 is a diagrammatic drawing depicting another case of the actual controlled snaking of the fixation belt, that is, the controlled snaking of the fixation belt, which occurs when the belt is rotated at a high speed, with no pressure applied to the belt.

Shown in FIG. 6 is the belt snaking controlling operation in which the rotational velocity of the belt 10 has been increased to 200 mm/s, and the amount of belt load is left at 0 [N]. The rotational velocity of the belt 10 in this operation is four times that of the operation shown in FIG. 5, quadrupling thereby the distance the belt 10 continues to move toward the point of "deviation limit", to roughly 96% of the control margin, or the distance between the point of "angle switch" and the point of "deviation limit". In other words, in this case, there is little margin left for the belt snaking control, making it very likely for a control error to occur at any moment.

Figure 7:
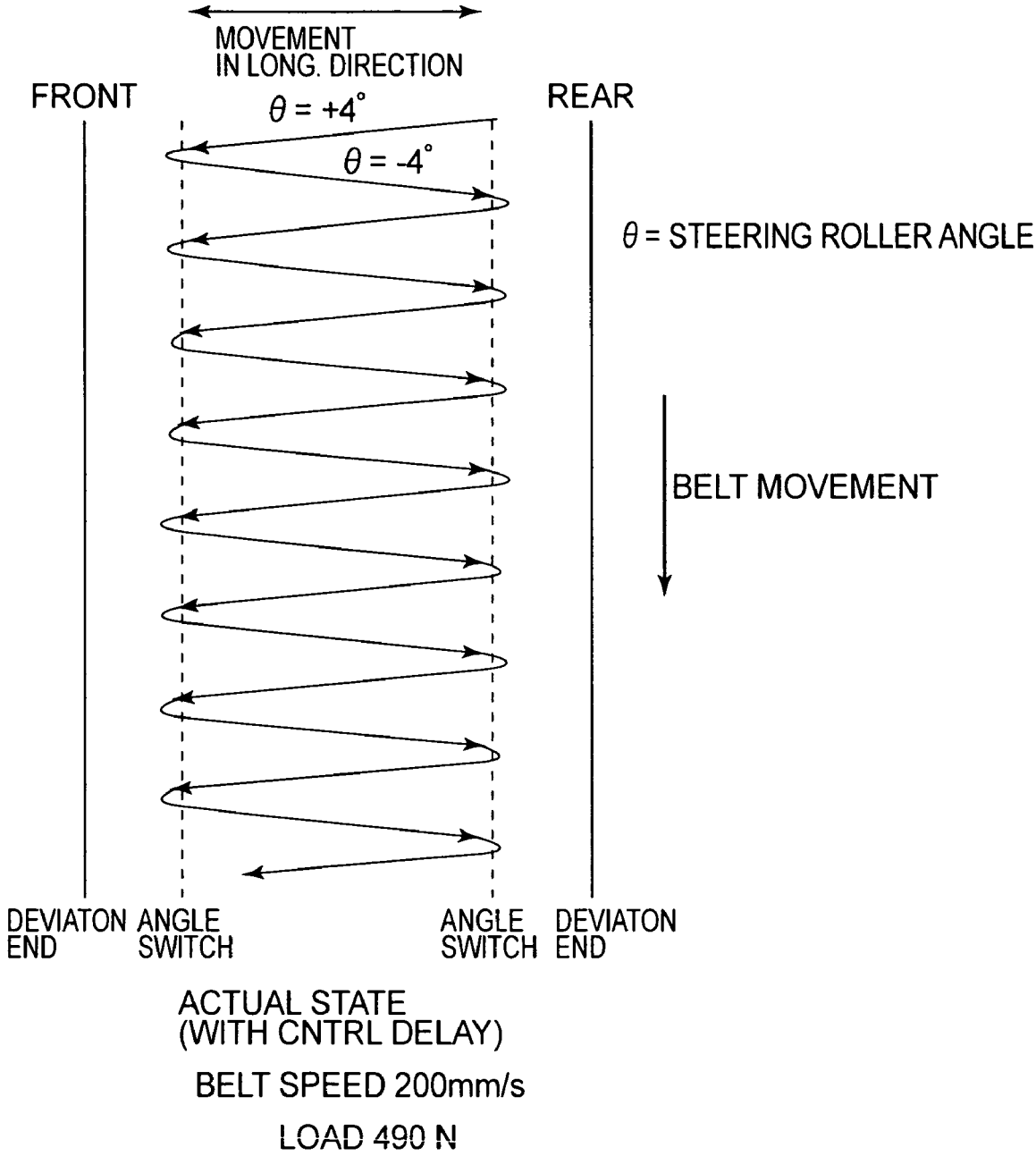
FIG. 7 is a diagrammatic drawing depicting another case of the actual controlled snaking of the fixation belt, that is, the controlled snaking of the fixation belt, which occurs when the belt is rotated at a high speed, with pressure applied to the belt.

Shown in FIG. 7 is the belt snaking controlling operation in which the rotational velocity of the belt 10 has been raised to 200 mm/s, and further, 490 [N] of pressure is applied to the belt 10 by the pressure applying member 4. The rotation velocity of the belt is the same as that in the belt snaking controlling operation shown in FIG. 6. In this case, however, the belt 10 is under the abovementioned amount of load. Therefore, the velocity at which the belt 10 moves in its width direction is lower than that in the belt snaking controlling operation shown in FIG. 6, and further, the amount of distance the belt 10 continues to move toward the point of "deviation limit" due to the control delay after it is detected that the lateral edge of the belt 10 is at the point of "angle switch" reduces to roughly 12% of the control margin. The belt deviation occurs as the belt unit itself goes out of alignment. It is also caused by the misalignment of the unit itself. However, as long as the amount of the positional deviation of the belt 10 attributable to the alignment errors, or the like, of the unit itself does not exceed the amount by which the belt 10 can be controlled in lateral shift by controlling the steering roller 6 in angle, the fixing apparatus 100 is more stable in terms of the control of the belt snaking when the rotational velocity of the belt is slower, and/or when the amount of load to which the belt 10 is subjected is higher.

As will be evident from the above description, the stability of the fixing apparatus 100 in terms of the control of the belt snaking is dependent upon the amount of the misalignment of the fixation belt of the fixing apparatus, the amount of control delay, the angle of steering roller, the rotational velocity of the belt, the amount of load to which the belt is subjected, etc.

Figure 8:
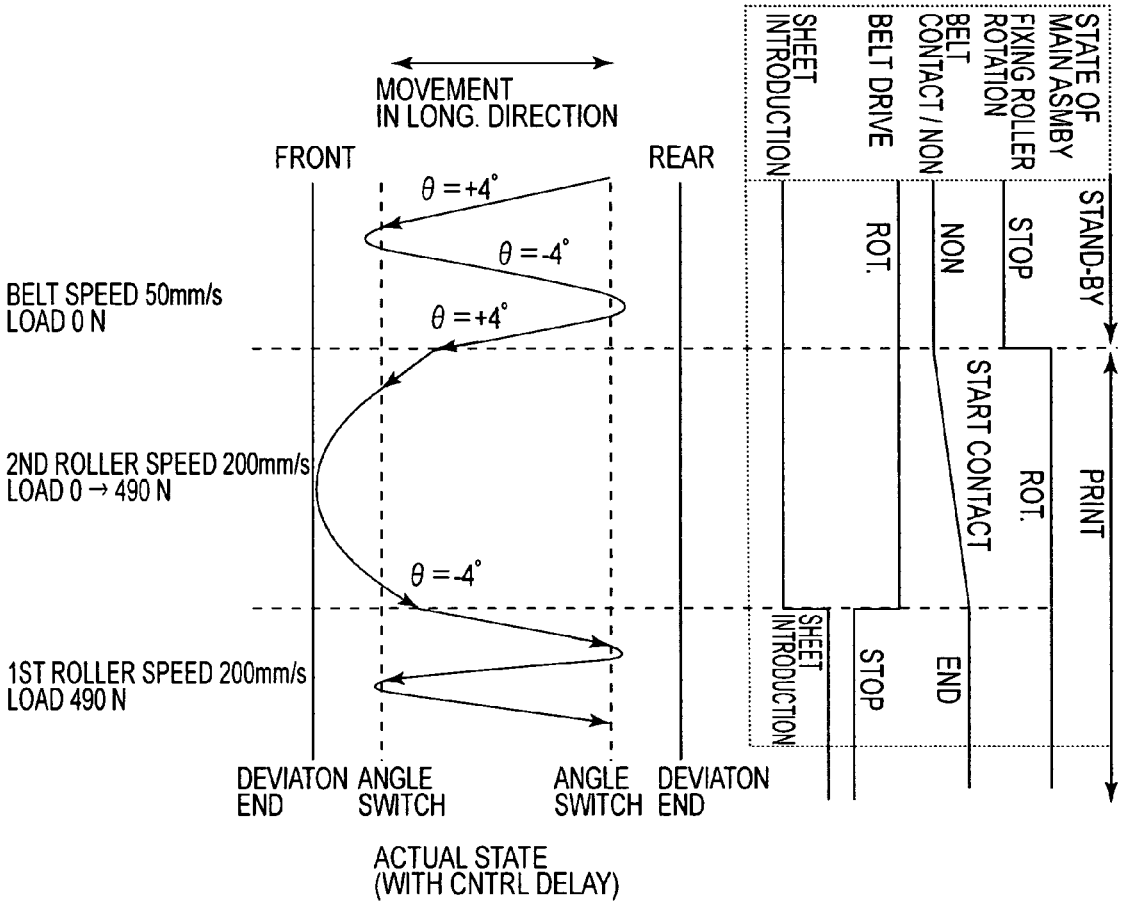
FIG. 8 is a diagrammatic drawing depicting the controlled snaking of the fixation belt of a fixing apparatus in accordance with the prior art which occurs when the belt is placed in contact with the fixation roller while the belt is rotated at a high speed.

The right-hand side of FIG. 8 is a diagrammatic drawing showing the rotation and stopping of the thermal fixing member and belt, the operation for placing the fixation belt in contact with the fixation roller, the operation for separating the fixation belt from the fixation roller, in the fixing apparatus in accordance with the prior art. The left-hand side of the FIG. 8 is a diagram, corresponding to the right-hand side of FIG. 8, showing the moment the fixing apparatus employing the fixation belt becomes unstable in the belt snaking control. When the main assembly of the image forming apparatus is on standby the fixation roller as a thermal fixing member is remaining still, whereas the belt is kept separated, and is continuously rotated at 50 mm/s by the belt driving mechanism for driving the belt when the apparatus is on standby. When the fixing apparatus is in this condition, there is a sufficient amount of margin for the belt snaking control. Therefore, the snaking of the belt is satisfactorily controlled. Then, at the same time as the main assembly begins a printing operation, the fixation roller begins to rotate at 200 mm/s, and the belt begins to be pressed upon the fixation roller. Here, the belt begins to rotate at 200 mm/s the moment it comes into contact with the fixation roller, whereas a brief length of time is necessary for the pressure applied to press the belt upon the fixation roller to builds up to its preset full strength. Therefore, there is a very brief length of time in which the amount of the pressure applied to the belt (fixation roller) is insufficient. Thus, if this period of time coincides with the time at which the steering roller is switched in angle, or is very near to this time, there is virtually no margin left for the belt snaking control. Therefore, a control error is very likely to occur.

In this embodiment, therefore, the following measure is taken to stabilize the fixing apparatus in terms of the belt snaking control. This measure will be described next with reference to FIGS. 1 and 9.

Figure 1:
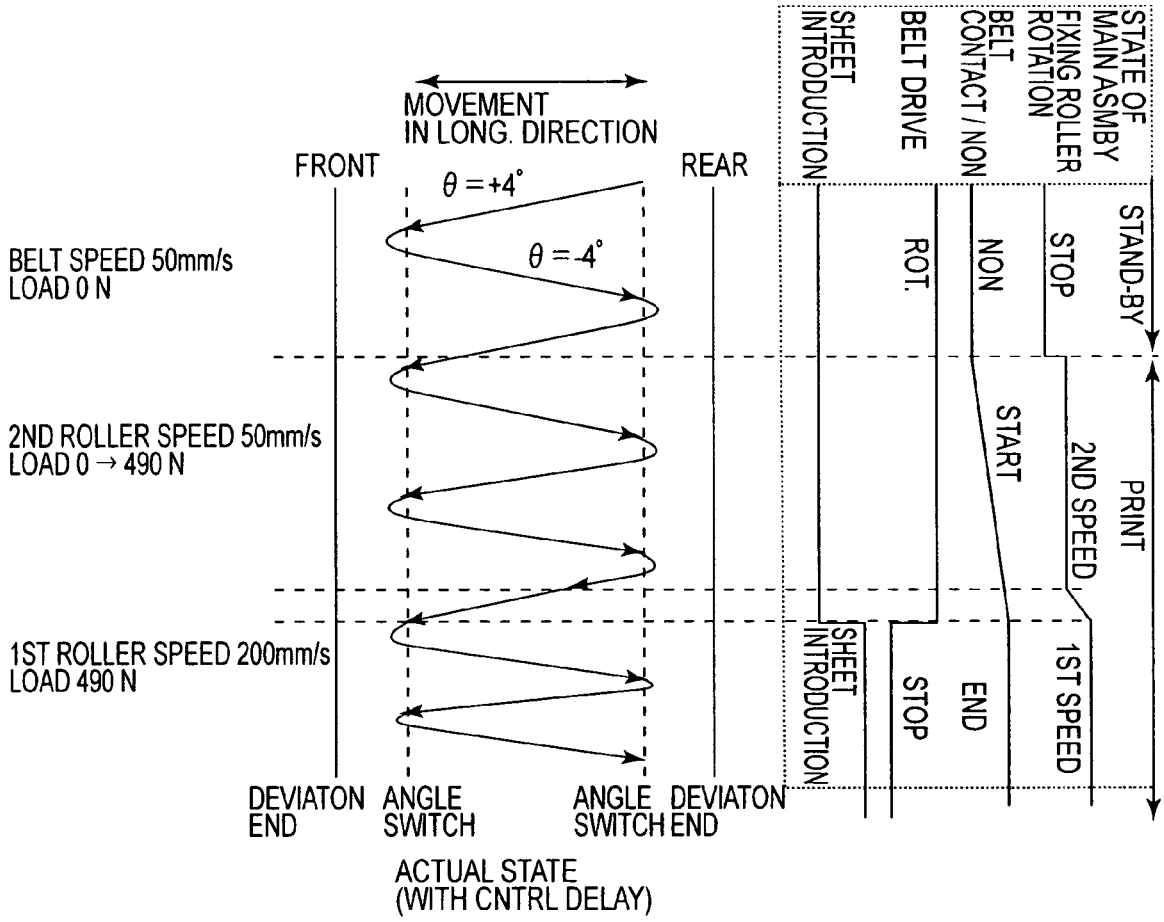
FIG. 1 is a diagrammatic drawing describing the control of the snaking of the fixation belt of the fixing apparatus in accordance with the present invention, the operation for placing the fixation belt in contact with the fixation roller, and the operation for separating the fixation belt from the fixation roller.

The right-hand side of FIG. 1 is a diagrammatic drawing showing the timing of the rotation of the fixation roller and fixation belt, the timing for placing the fixation belt in contact with the fixation roller, and the timing for separating the fixation belt from the fixation, whereas the left-hand side of FIG. 1 is a diagrammatic drawing, which correspond in operational timing to the right-hand side of FIG. 1, showing the stable controlled snaking of the belt.

Figure 9:
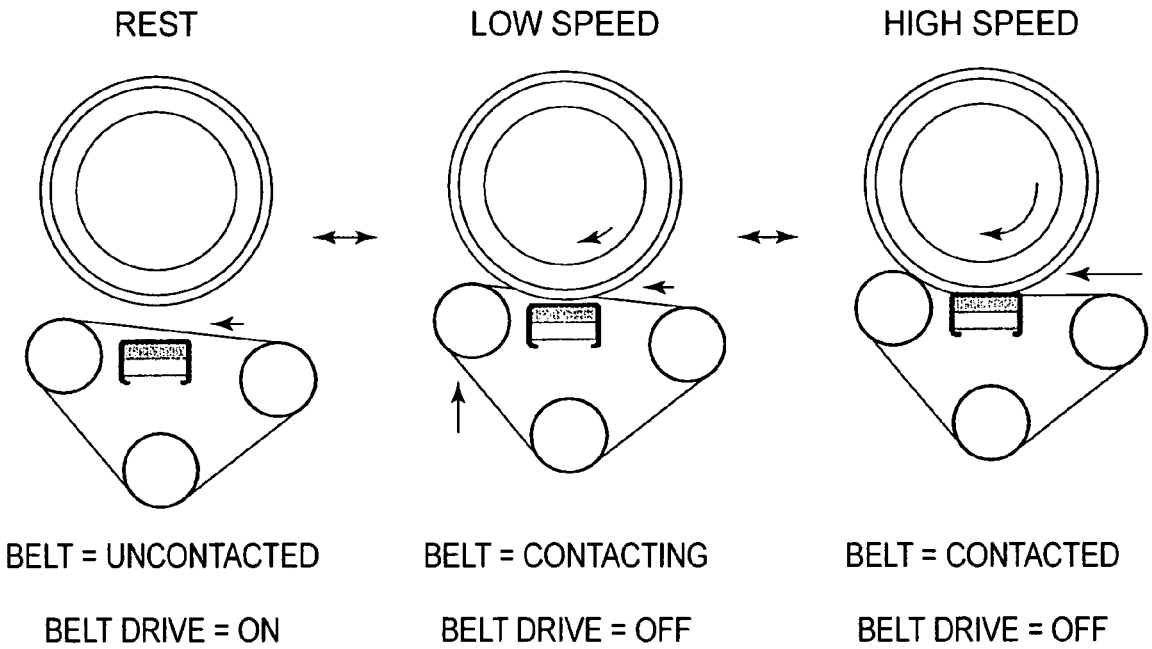
FIG. 9 is a sectional view of the fixing apparatus in accordance with the present invention, showing its operation for placing the fixation belt in contact with the fixation roller, and its operation for separating the fixation belt from the fixation roller.

FIG. 9 is a schematic sectional view of the fixation roller 1 and belt 10, showing their rotation, the operation for placing the belt 10 in contact with the fixation roller 1, and the operation for separating the belt 10 from the fixation roller 1.

First, when the main assembly of the image forming apparatus is kept on standby, the fixation roller remains stopped, whereas the belt 10 is continuously rotated at 50 mm/s by the aforementioned motor while being kept separated from the fixation roller 1. In this condition, there is a substantial amount margin for the belt snaking control. Therefore, the control of the belt snaking remains stable.

Next, a case in which an image forming operation in which an image is formed on thin recording medium such as a piece of thin or ordinary paper is carried out will be described.

As a print start signal is inputted into the image forming apparatus, the fixation roller begins to rotate at 50 mm/s, which is the slower peripheral velocity of the two peripheral velocities (50 mm/s and 200 mm/s) available for fixation. At virtually the same time, the belt 10 moves from its retreat position to its operational position, in which the belt 1 begins to be pressed against the fixation roller 1.

As described above, in this embodiment, when the belt is placed in contact with the fixation roller, the fixation roller is being rotated at the peripheral velocity for standby, which is the slower peripheral velocity for the fixation roller, or 50 mm/s, and the belt begins to rotate at the slower velocity. Therefore, the control of the snaking of the belt remains stable.

Thus, even if the time at which the belt comes into contact with the fixation roller 1 coincides with the time at which the belt 10 is switched in its snaking direction (or is near this time), it does not occur that the margin for the belt snaking control reduces. Therefore, there is no possibility that the belt will deviate beyond the normal snaking range (normal oscillatory range), and therefore, there is no possibility that the on-going image forming operation will have to be interrupted (printing job will have to be interrupted).

Then, as the pressure gradually builds up, the control of the belt snaking becomes more stable. Then, as the pressure reaches its preset full strength, or satisfactory level, the peripheral velocity of the fixation roller is increased to the fixation speed, or 200 mm/s, before the recording paper is introduced into the fixation nip. Therefore, the control of the belt snaking remains stable even when the rotational velocity of the fixation belt 1 is increased as described above.

Incidentally, when an image forming operation in which an image is formed on thick recording medium such as cardstock or coated paper is started, the belt 10 and fixation roller 1 are not increased in velocity, that is, they are continuously rotated at 50 mm/s, even after the pressure applied to press the belt 10 against fixation roller 1 becomes sufficiently high.

Further, the peripheral velocity at which the fixation roller 1 (belt 10) is rotated for fixation may be increased based on the type of recording medium. As for the means for increasing the peripheral velocity of the fixation roller 1 based on the type of recording medium, the peripheral velocity of the fixation roller may be adjusted by the controller to an optimal velocity based on the type of recording medium. Incidentally, if the fixing apparatus is structured so that its fixation roller can be rotated for fixation at one of three or more peripheral velocities, the peripheral velocity at which the fixation roller is rotated when the belt is placed in contact with the fixation roller is desired to be set to the slowest of the three or more peripheral velocities available for the fixation roller.

As described above, according to the present invention, it is possible to prevent a fixing apparatus, which employs a fixation belt and is provided with a fixation belt snaking control function, from becoming unstable in fixation belt snaking control when the fixation belt is placed in contact with the fixation roller. Therefore, it is possible to output high quality images at a high speed.

Incidentally, in the above described embodiment of the present invention, the fixing apparatus was structured so that the slower of the two peripheral velocities for the fixation roller is selected as the peripheral velocity for the fixation roller when the belt is placed in contact with the fixation roller. However, the application of the present invention is not limited to the above described structural arrangement. For example, the present invention is also applicable to the fixing apparatus structured so that, instead of the slowest of the multiple peripheral velocities available for the fixation roller, any one of the peripheral velocities available for the fixation roller, which is slower than the fastest velocity, is selected as the peripheral velocity for the fixation roller when the belt is placed in contact with the fixation roller.

Further, in the above described embodiment of the present invention, the fixing apparatus is structured so that the rotational velocity at which the belt is to be rotated while the main assembly of the image forming apparatus is kept on standby was set to 50 mm/s, which is the same as the fixation speed for an image forming operation in which cardstock or coated paper is used as recording medium. However, the application of the present invention is not limited to a fixing apparatus structured as described above. For example, the present invention is also applicable to a fixing apparatus structured so that the value to which the rotational speed of the belt 10 is set when the main assembly of the image forming apparatus is kept on standby is 30 mm/s, which is not one of the fixation speeds.

Also in the above described embodiment of the present invention, the fixing apparatus was structured so that the belt was suspended by three rollers. However, the application of the present invention is not limited to a fixing apparatus structured so that the belt is suspended by three rollers. That is, the present invention is compatible with a structural arrangement in which the fixation belt is suspended by two rollers, that is, the separation roller and steering roller.

Also in the above described embodiment of the present invention, a "roller" is employed as an image fixing member on the image fixing side (image fixing member on side on which image fixing member comes into contact with image on recording medium), and a "belt" is employed as an image fixing member on the pressure applying side (image fixing member on the opposite side of recording medium from the surface on which image is borne). However, the application of the present invention is not limited to the above described embodiment. For example, the present invention is also compatible with a structural arrangement in which a "belt" is employed as the image fixing member on the fixation side, and a "roller" is employed as the image fixing member on the pressure applying side.

Further, in the above described embodiment of the present invention, the example of an image heating apparatus was a fixing apparatus. However, the present invention is also applicable to the following image heating apparatuses: an image heating apparatus (purpose) for temporarily fixing a toner image to recording medium; an image heating apparatus (purpose) for reheating a toner image, which has been temporarily pre-fixed to recording medium, in order to improve the toner image in glossiness.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 266010/2005 filed Sep. 13, 2005 which is hereby incorporated by reference.

What is claimed is:

1. An image heating apparatus comprising:

a heating rotatable member for heating, in a nip, an image on a recording material;

a belt cooperative with said heating rotatable member to form the nip, said belt being movable between a contact position in which said belt is in contact with said heating rotatable member and in which an image heating operation is capable, and a retracted position in which said belt is retracted from said heating rotatable member;

swinging means for swinging said belt in a widthwise direction; and control means for controlling a rotational speed of said heating rotatable member, wherein said control means rotates said heating rotatable member at a relatively low speed when said belt is brought into contact to said heating rotatable member and while said swinging means is swinging said belt, and wherein said control means effects an increase of the rotational speed of said heating rotatable member before the heating operation is started.

2. An apparatus according to claim 1, wherein said control means changes the rotational speed of said heating rotatable member after the increase in accordance with a kind of the recording material.

3. An apparatus according to claim 1, wherein the low speed corresponds to a lowest one of peripheral speeds at which said heating rotatable member is rotatable during the heating operation.

4. An apparatus according to claim 3, wherein said control means is capable of executing a speed increasing mode in which the peripheral speed of said heating rotatable member is increased and a low speed maintaining mode in which the peripheral speed of said heating rotatable member is maintained at a low speed, and said control means is capable of selecting one of the modes in accordance with a kind of the recording material.

5. An apparatus according to claim 1, wherein said heating rotatable member includes a roller.

* * * * *